United States Patent [19]

Bowers

[11] Patent Number: 4,496,394

[45] Date of Patent: Jan. 29, 1985

[54] CONTINUOUS METHOD OF REMOVING TIN FROM LEAD

[75] Inventor: John E. Bowers, Oxford

[73] Assignee: BNF Metals Technology Centre, Oxfordshire, England

[21] Appl. No.: 514,023

[22] Filed: Jul. 15, 1983

[30] Foreign Application Priority Data

Jul. 16, 1982 [GB] United Kingdom ..... 8220733

[51] Int. Cl.[3] ..... C22B 13/06

[52] U.S. Cl. ..... 75/63; 75/78

[58] Field of Search ..... 75/63, 78

[56] References Cited

U.S. PATENT DOCUMENTS 2,235,423 3/1941 Erickson ..... 75/78

*Primary Examiner*—M. J. Andrews

*Attorney, Agent, or Firm*—Wenderoth, Lind & Ponack

[57] ABSTRACT

The invention relates to a continuous method of removing tin from lead. The method comprises maintaining a pool of molten lead at a temperature of from 510° C. to 570° C., introducing molten lead into the pool, injecting chlorine and oxygen into the molten lead in an amount to react with tin present as an impurity in the lead to form a tin-containing dross and then separating the lead from the dross.

Separation may either be performed in the reaction vessel itself or in a separate settlement vessel.

9 Claims, 3 Drawing Figures

CONTINUOUS METHOD OF REMOVING TIN FROM LEAD

Secondary lead typically contains copper, tin, antimony and arsenic as impurities. Primary lead typically contains these together with bismuth, silver and other impurities. It is generally desired to separate these impurities from the lead and to recover each one separately, although antimony and arsenic may be recovered together. After removal of copper, tin can be separated from lead by oxidation, either together with, or more usually separate from, antimony and arsenic. The continuous process of the present invention is designed so that tin can be removed from lead in the presence of antimony without becoming contaminated with substantial quantities of antimony.

Removal of tin is conventionally effected on a batch basis by providing a pool of molten lead at about 500° C., stirring in air and possibly also chlorine until sufficient oxidation has taken place, then allowing the pool to settle and removing a layer of dross from the surface. The process requires substantial investment in both capital and energy, since a large body of lead has to be maintained at 500° C. for several hours, is inflexible, metallurgically inefficient, produces toxic wastes and gases, and is labour intensive, particularly at the dross-removal stage.

There has long been a need for a continuous process for removing tin from lead. A paper by J. F. Castle and J. H. Richards in "Advances in extractive metallurgy 1977" reports on work on a continuous de-tinning process carried out between 1961 and 1963 at Imperial Smelting Corporation, Avonmouth, and says that a refinery built on the principles there put forward would have advantages over conventional batch processing in capital savings in refining and gas-cleaning equipment, and building, lower working capital for metal in process, operating costs in maintenance, labour and fuel, flexibility of through-put, improved hygiene, as reactors can be sealed, and the reduction in arduous work, as dross removal lends itself to mechanization. A difficulty facing continuous refiners has been the need to perform refining operations quickly so as to avoid having a large volume of molten process metal. The present invention overcomes this difficulty and fulfils the above long-felt need.

The invention provides a continuous method of removing tin from lead, which method comprises maintaining and stirring a pool of molten lead at a temperature of from 510° C. to 570° C., introducing molten lead into the pool, injecting chlorine and oxygen into the molten lead in an amount to react with tin present as an impurity in the lead to form a tin-containing dross, and separating the lead from the dross.

The temperature of the molten lead is maintained at from 510° C. to 570° C., preferably 525° C. to 550° C. If the temperature is too low, the reaction is too slow, and it becomes necessary to retain the lead for an unacceptably long time in the reaction zone. The upper temperature limit is not so critical, but at higher temperatures increasing amounts of antimony come out with the tin.

The residence time of the molten metal in the reaction zone is preferably arranged to be from 5 to 60 minutes, and the temperature and flow of oxygen and chlorine adjusted to ensure sufficient removal of tin during that period.

In one embodiment of the invention, the pool of molten lead is preferably maintained in a stirred vessel, to which impure lead is added at the top and from which a mixture of lead and dross is removed near the bottom and passed to a separate settlement zone for separation of the lead from the dross. The flow of lead is down the vessel and thus countercurrent to the flow of oxygen and chloride which are injected in the lower part of the vessel. These conditions may result in a pool of lead which is not homogeneous but which varies in composition from top to bottom.

Stirring should be at a sufficient rate to maintain the dross in dispersion in the molten lead, rather than allowing it to float to the surface, suitably at a rate of from 100 to 3000 rpm.

In one alternative embodiment, the dross may be arranged to separate from the molten lead in the reaction vessel. For this purpose, stirring should be sufficiently gentle not to hold the dross in suspension, and may for example be at a rate of from 10 to 150 rpm. In this embodiment the dross is recovered from the surface of the pool, and the molten lead from a lower part of the reaction vessel.

Of the two embodiments described, the former, involving rapid stirring of the contents of the reaction vessel and separation of dross from lead in a separate settlement zone, is preferred. This is because conditions in the reaction vessel and the settlement zone can each be optimised for their respective purposes, making control of the overall process easier.

To provide a sufficient degree of countercurrent flow, the vessel containing the pool of molten lead should preferably be vertically elongated, that is to say the ratio of the depth of the molten pool to its average diameter should preferably be at least 1 and desirably in the range 1.5 to 5.

The gas should preferably be injected into the pool at least 200 mm, desirably at least 500 mm, below the surface of the molten lead, with the object that the bubbles of gas should all react and dissolve before reaching the surface of the pool. If vertical lances are used extending from above the surface of the molten pool, the nozzle at the bottom should inject the gas with some horizontal momentum so that the bubbles do not travel up the wall of the lance. A suitable material for the injectors is nickel-free heat-resisting or stainless steel of chromium content greater than 10%.

It is possible to use oxygen diluted with nitrogen in the form of air, but this is not preferred because of the added turbulence caused by the larger volume of gas. Also the inert gas becomes contaminated with metal vapour and must be cleaned before expelling to atmosphere. While oxygen can be used without chlorine to convert tin metal to dross, this is somewhat wasteful because some of the lead is also oxidized. The use of chlorine enables less oxygen to be used and makes the reaction more selective, that is to say the tin is oxidized without any substantial proportion of the lead. While clearly enough oxygen and chlorine must be used to oxidize the tin to be removed, the use of a substantial excess is not preferred since this merely results in the unwanted oxidation of lead. It is preferred to use from 100 to 2000, particularly from 200 to 800 liters of chlorine per ton of molten lead; and from 100 to 2000, particularly from 200 to 1000 liters of oxygen per ton of molten lead, all volumes expressed at S.T.P. The optimum amounts of both gases will depend on the tin content of the impure lead, which is typically in the range 0.1 to 0.5%.

In the preferred embodiment, the mixture of lead and dross is removed from the lower part of the pool and passed to a settlement vessel with lead fed in at the top and siphoned from the bottom. The dross remains on the surface of the settlement vessel while the lead gradually flows downwards, at a rate which depends on the rate of feed and the diameter of the vessel. The rate of flow of lead should be less than the rate of sedimentation of fine particles of dross to the surface, and the diameter of the settlement vessel should be determined with this in mind. The dross may be removed from the surface pneumatically, or by raking, or other conventional means.

Figure 1:
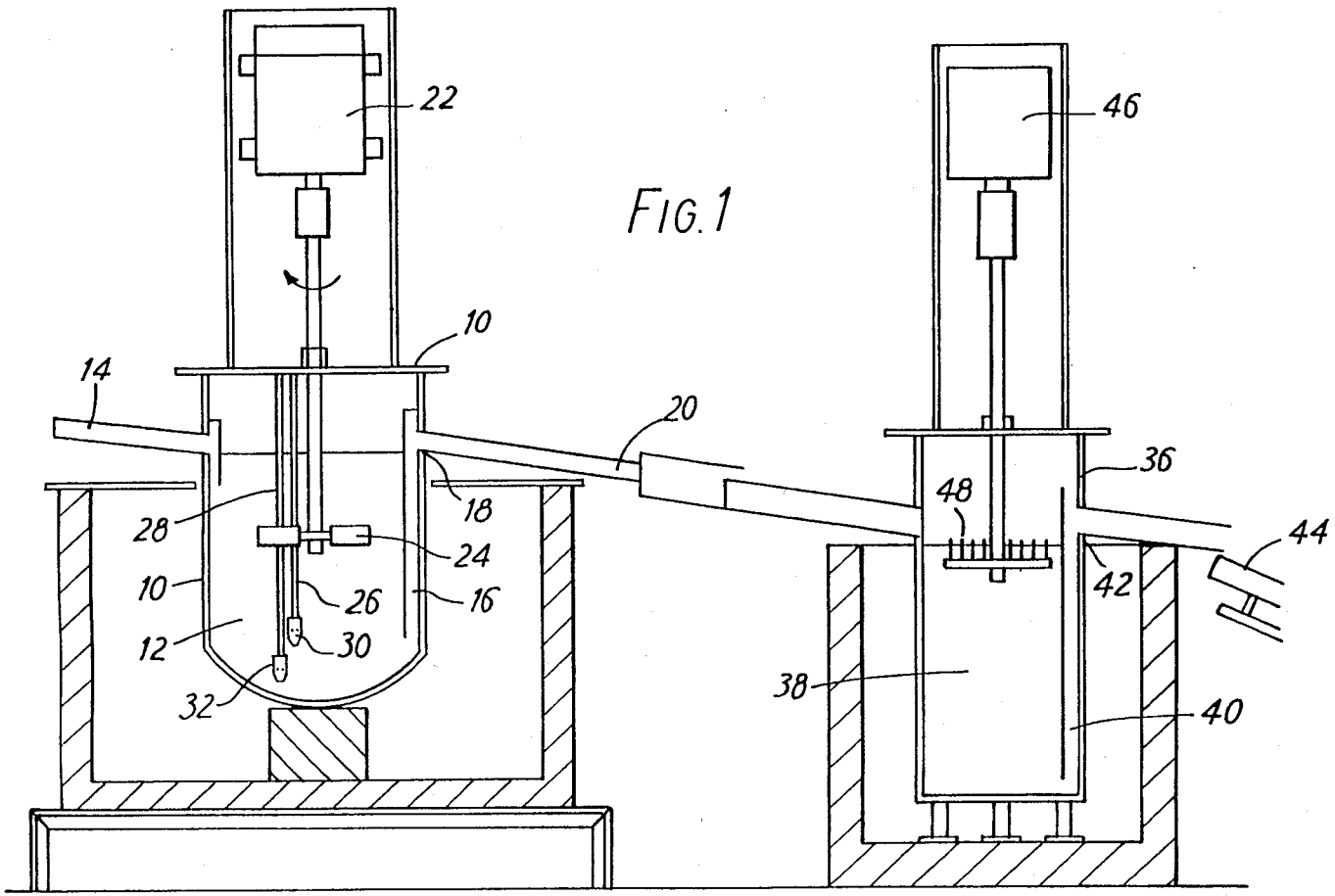
FIG. 1 is a schematic sectional side elevation of equipment for performing the method of the invention.

Referring to the drawings, a closed reaction vessel 10 contains a pool 12 of molten lead 760 mm deep and 460 mm in diameter. A launder 14 is provided for introducing impure molten lead to the surface of the pool. A siphon 16, weir 18 and launder 20 are provided for removing a mixture of lead and dross from the lower regions of the pool. A three horse power motor 22 acts to rotate a stirrer 24. Lances 26, 28 for oxygen and chlorine respectively are provided at their lower ends with nozzles 30, 32, positioned near the bottom of the molten pool.

Figure 2:
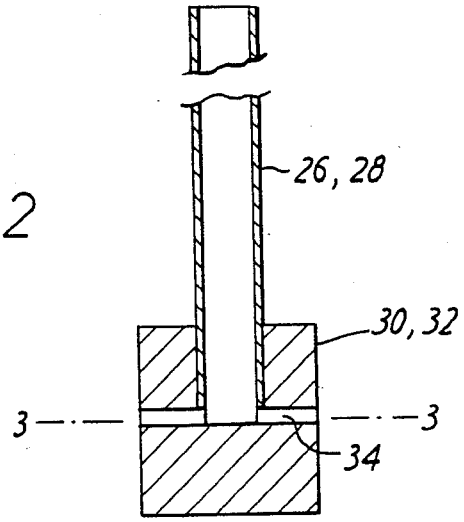
FIG. 2 is a sectional side elevation of a lance for injecting gas.
Figure 3:
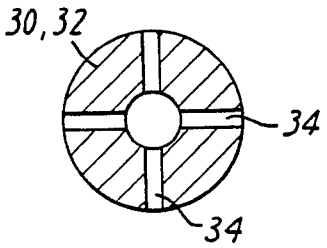
FIG. 3 is a section through the nozzle of the lance along the line A—A of FIG. 2.

Referring particularly to FIGS. 2 and 3, each lance consists of a stainless steel tube 26, 28 leading to a nozzle 30, 32 comprising four horizontal holes 34 at right angles, each hole being approximately 6 mm in diameter.

The settlement tank is a closed cylindrical vessel 36. In the experiments reported below, the tank was 460 mm in diameter, but a larger tank would be used in commercial operation. The launder 20 introduces a mixture of lead and dross to the surface of a pool 38 of molten metal in the tank. Purified lead is removed via a siphon 40, weir 42 and heated launder 44. A two horse power motor 46 rotates a rake 48 positioned at the surface of the pool 38 and dries the layer of dross, which is continuously removed (by means not shown) in such a way as to leave a continuous layer on the pool.

In use, molten lead at 400° C. is introduced into the pool 12 via the launder 14 at a rate of 3 tons per hour. The vessel 10 is heated (by means not shown) to maintain its temperature in the range 530° to 540° C. The stirrer 24 is caused to rotate at a speed of 720 rpm. Oxygen and chlorine are injected via lances 26 and 28 at rates varying from about 10 to 30 liters per minute. The capacity of the reaction vessel 10 is such that the residence time therein of the lead is a little under 30 minutes. The rake 48 in the settling tank is caused to rotate at a speed of 91 rpm.

Experiments performed according to the invention gave the results set out in the following table. Run No. 6 was performed in equipment as described above and illustrated in FIGS. 1 to 3. Runs 1 to 5 were performed in equipment which was similar except that no settlement tank 36 was provided. The pool of molten metal 12 was stirred at the slow rate of 90 rpm under conditions such that the dross floated to the surface, from which it was removed. Molten lead was continuously removed over the weir 18. The results of the experimental runs were as follows, gas volumes being expressed at STP.

| Run No. | Temperature °C. | Chlorine l/m | Oxygen l/m | Tin % Input | Tin % Output |
|---|---|---|---|---|---|
| 1 | 533 | 27 | 9 | 0.16 | 0.006 |
| 2 | 535 | 18 | 9 | 0.16 | 0.012 |
| 3 | 537 | 27 | 18 | 0.21 | 0.011 |
| 4 | 539 | 18 | 27 | 0.21 | 0.010 |
| 5 | 535 | 27 | 27 | 0.21 | 0.008 |
| 6 | 537 | 18 | 18 | 0.21 | 0.008 |

I claim:

1. A continuous method of removing tin from lead, which method comprises maintaining a pool of molten lead in a reaction vessel at a temperature of from 510° to 570° C., continuously introducing molten lead containing tin as an impurity into the pool, injecting chlorine and oxygen gas into the molten lead in an amount to react with the tin present in the lead to form a tin-containing dross, the residence time of the molten lead in the reaction vessel being from 5 to 60 minutes, and separating the lead from the dross.

2. A method as claimed in claim 1, wherein said molten lead is maintained in an unstirred or substantially unstirred reaction vessel to which impure lead is added at or near the top, such that separation is allowed to occur within the reaction vessel and the tin-containing dross rises to the surface and is removed therefrom, whilst molten lead is removed from a lower part of the vessel.

3. A method as claimed in claim 1, wherein said pool of molten lead is maintained at a temperature of from 525° C. to 550° C.

4. A method as claimed in claim 1, wherein the reaction vessel containing the pool of molten lead is vertically elongated such that the ratio of its depth to average diameter is in the range of 1.5 to 5.0.

5. A method as claimed in claim 1, wherein said oxygen and chlorine gases are injected into the pool of molten lead in the reaction vessel at least 500 mm below its surface of the molten lead.

6. A continuous method of removing tin from lead, which method comprises maintaining a pool of molten lead in a stirred reaction vessel at a temperature of from 510° to 570° C., continuously introducing molten lead containing tin as an impurity at or near the top of the pool, injecting chlorine and oxygen gas into the molten lead in an amount to react with the tin present in the lead to form a tin-containing dross, the residence time of the molten lead in the reaction vessel being from 5 to 60 minutes, recovering the mixture of lead and dross from at or near the bottom of the reaction vessel and passing it to a separate settlement zone for separation of the lead from the tin-containing dross.

7. A method as claimed in claim 6, wherein said molten lead is stirred at a rate of from 100 to 3000 rpm.

8. A method as claimed in claim 6, wherein said settlement zone comprises a vessel to which the mixture of lead and dross is added at or near the top and is allowed to separate, purified lead being removed from the bottom of the vessel and the tin-containing dross being removed from the surface thereof.

9. A method as claimed in claim 1, wherein from 200 to 1000 liters of oxygen, and from 200 to 800 liters of chlorine, are injected for every ton of molten lead.

* * * * *